US011203481B2

(12) United States Patent
Ding et al.

(10) Patent No.: US 11,203,481 B2
(45) Date of Patent: Dec. 21, 2021

(54) DOUBLE-LAYER CONTAINER

(71) Applicants: Jiaoping Ding, Taizhou (CN); Yufan Ding, Taizhou (CN)

(72) Inventors: Jiaoping Ding, Taizhou (CN); Yufan Ding, Taizhou (CN)

(73) Assignees: Kraftpack (Hubei) Industrial Co., Ltd., Jingshan (CN); Jiaoping Ding, Taizhou (CN)

( * ) Notice: Subject to any disclaimer, the term of this patent is extended or adjusted under 35 U.S.C. 154(b) by 37 days.

(21) Appl. No.: 16/740,395

(22) Filed: Jan. 11, 2020

(65) Prior Publication Data

US 2020/0231363 A1 Jul. 23, 2020

(30) Foreign Application Priority Data

Jan. 17, 2019 (CN) ..... 201910044293.6

(51) Int. Cl.
*B65D 81/38* (2006.01)
*B65D 3/22* (2006.01)
*B65D 3/26* (2006.01)

(52) U.S. Cl.
CPC ..... *B65D 81/3869* (2013.01); *B65D 3/22* (2013.01); *B65D 3/265* (2013.01); *B65D 81/3874* (2013.01)

(58) Field of Classification Search
CPC ..... B65D 81/3869; B65D 3/22; B65D 3/265; B65D 81/3874; B65D 1/265; B65D 81/3865; B65D 2543/00509; A47G 19/2288; A47G 19/03; B32B 27/10; B32B 2317/12; B32B 29/00; B29C 44/24
USPC ..... 229/403, 4.5, 400, 122.32, 919; 220/592.17, 62.12, 592.16, 592.25, 62.18, 220/646, 903; 493/152, 108, 111
See application file for complete search history.

(56) References Cited

U.S. PATENT DOCUMENTS 5,007,578 A * 4/1991 Simone ..... B65D 3/28 206/459.5
5,685,480 A 11/1997 Choi
5,996,887 A * 12/1999 Cai ..... B65D 3/06 206/831
2007/0051790 A1* 3/2007 Smith ..... B65D 3/06 229/400
2008/0087715 A1 4/2008 Robertson et al.
(Continued)

FOREIGN PATENT DOCUMENTS

EP 3287380 A1 2/2018
KR 20180001286 U 5/2018
WO WO2011023400 A1 3/2011

*Primary Examiner* — Christopher R Demeree
(74) *Attorney, Agent, or Firm* — Minder Law Group; Willy H. Wong

(57) ABSTRACT

A double-layer container comprises an inner container made of plastic and having a bottom, and a cylindrical outer layer made of paper. The outer layer is sleeved outside the inner container, a locking structure is provided between the outer layer and the inner container to snap the outer layer on an outer peripheral surface of the inner container, and the outer layer is provided with a tear tab capable of tearing and destroying the outer layer. The double-layer container reinforces the strength of the inner container and the outer layer in a radial direction through an annular groove and an annular protrusion respectively, so that the overall strength is high, and quick recycle is realized through the tear tab provided on the outer layer.

18 Claims, 6 Drawing Sheets

(56) References Cited

U.S. PATENT DOCUMENTS

| | | | | |
|---|---|---|---|---|
| 2015/0048086 | A1 | 2/2015 | Brown | |
| 2015/0360845 | A1 | 12/2015 | Stahlecker | |
| 2016/0046436 | A1* | 2/2016 | Haddad | B65D 85/72 426/112 |
| 2019/0322439 | A1* | 10/2019 | Leung | A47G 19/03 |

* cited by examiner

DOUBLE-LAYER CONTAINER

RELATED APPLICATIONS

This application claims priority to Chinese Patent Application No. CN201910044293.6, filed Jan. 17, 2019.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the technical field of containers, and more particularly to a double-layer container.

Related Art

Disposable containers are disposable items that need to be thrown away after one time of use, such as paper cups, paper bowls, plastic cups, plastic bowls, etc. Such as paper cups, which use cardboard to form a single-layer cup by rolling up and bonding technics. Because the cup made of pure cardboard is easy to soften to cause leakage when exposed to water, the water or beverage contained in the cup cannot be held for a long time, and the softened cup is not easy to pick up. Therefore, disposable paper cups are usually sprayed with a thin layer of waterproof polyethylene (PE) film on a side in contact with water and coated with a layer of edible wax on the PE film.

In order to solve the problem of anti-scalding, a double-layer container is designed, that is, the above-mentioned single-layer paper cup is used as an inner cup, and an outer cup is added outside the inner cup. There is an anti-scalding gap between the outer cup and the inner cup. When the outer cup is held, the hand will not directly touch the inner cup to prevent being scalded. This type of double-layer paper cup has been used in a large number, and because it is made of paper material, it is very convenient to recycle.

In recent years, there are further requirements for the durability of double-layer containers on the market. Therefore, plastic inner cups made of degradable plastic have been introduced, and a paper outer cup is sleeved outside the plastic inner cup with a gap provided between the paper outer cup and the plastic inner cup to form a double-layer container of plastic and cardboard combination, such as the disposable paper-plastic insulation cup and the paper cup insulation structure disclosed in the prior art. In addition, the bottom of the outer cup of the double-layer container with such structures is folded into a two-layer structure for reinforcement. As a result, the lower part of the outer cup cannot form an effective reinforcement structure. Therefore, it is required to reinforce by glue bonding. The cup is easy to deform in the radial direction if glue bonding is not used. When the outer cup is picked up, the outer cup will contact the inner cup after being deformed under pressure. Moreover, the inner cup does not have a reinforced structure, the inner cup is also easily deformed when heated, resulting in poor overall strength, and it is easy to burn your hands when the cup is used to hold hot water.

This type of double-layer container formed of plastic and paper has a big drawback that it is not very environmentally friendly. Although it is made of degradable plastic, the degradation time of the degradable plastic takes 2-3 years, the usage amount of disposable cups is also huge, and random disposal will also cause a great burden on the environment. Therefore, it is necessary to recycle such double-layer containers. However, because anti-scalding and convenience of use are taken into consideration for this type of double-layer container, the connection between the outer cup and the inner cup is very strong, and the connection between the plastic inner cup and the paper outer cup needs to be fixed by glue, which will cause great difficulties in recycling: First, because this type of double-layer cup is made of different materials, the inner cup and the outer cup must be separated during recycling, but the outer cup and the inner cup are firmly bonded by glue, and the outer cup is difficult to handle so as to separate the outer cup from the inner cup; and second since the glue adhered to the plastic inner cup is an impurity for recycling operation, but the glue is difficult to be removed from the plastic inner cup, which makes the purification of recycled plastic very difficult.

In addition to the plastic inner cup and paper outer cup being directly bonded by glue, some inventors have disclosed the snap-connect structure for fixing the inner cup and the outer cup, and the snap-connect structure is applied to connect the plastic inner cup with the paper outer cup. For example, in the double-layer container disclosed in the prior art, the locking structure of the double-layer container is a step formed on the inner wall of the outer cup, the bottom of the inner cup is placed on the step, and the edge of the outer cup is inserted into the rolled up edge of the inner cup. It is apparent that the structural strength of this snap-connect structure is not high, especially the inner cup is easily detached from the outer cup. Therefore, glue bonding is also required to prevent the inner cup from being easily detached from the outer cup, and the overall strength of this snap-connect structure is not high. As mentioned above, it is only reinforced by the structure folded in two layers at the bottom of the outer cup in the radial direction, and the inner cup is not reinforced in the radial direction. When the outer cup and the inner cup are connected by snapping, there is only a single direction snapping in the up and down directions, the overall structural strength is not high, and it is easy to burn your hands when the cup is used to hold hot water.

Therefore, a double-layer container with sufficient overall strength and easy to recycle is expected by the market.

SUMMARY OF THE INVENTION

In view of the above-mentioned technical problems in the prior art, one embodiment of the present invention discloses a double-layer container. One technical problem to be solved by the present invention is how to make the double-layer container to have high overall strength and capable of being recycled quickly.

One embodiment of the present invention is achieved by the following technical solution:

A double-layer container, comprising: an inner container made of plastic and having a bottom, an outer layer made of paper and in a shape of a cylinder, sleeved outside the inner container, a locking structure provided between the outer layer and the inner container to snap the outer layer on an outer peripheral surface of the inner container; wherein the locking structure comprises an annular groove formed on the outer peripheral surface of the inner container and recessed in a radial direction of the inner container, and an annular protrusion formed on an inner peripheral surface of the outer layer in a rolled up manner, the annular protrusion is embedded in the annular groove; and wherein and the outer layer is provided with a tear tab capable of tearing and destroying the outer layer.

One embodiment of the double-layer container uses the glue-free locking structure to lock the outer layer on the inner container, so that the outer layer is firmly connected on the inner container, which is not easy to separate from the inner container. For recycling after the double-layer container is used, through the tear tab disposed on the outer layer, the outer layer can be easily destroyed and torn off, so that the outer layer can be easily separated from the inner container, thereby obtaining the plastic inner container without glue impurities, and realizing rapid recycle. The outer layer is formed with the annular protrusion, so that the outer layer forms a reinforcement similar to an arch bridge in the radial direction, especially after the annular shape is formed, reinforcement in the radial direction is maximized, so that the container is not easily deformed. On this basis, the annular groove formed on the outer peripheral surface of the inner container also reinforces the inner container in the radial direction, and after the annular protrusion is embedded in the annular groove, the annular protrusion supports the annular groove of the inner container in the radial direction, so that the overall strength in the radial direction after connection is further improved. Therefore, this structure is capable of reinforcing the overall strength of the outer layer connecting on the inner container. At the same time, during manufacture, a roll up thickness of the annular protrusion or a roll up depth of the annular groove can be controlled, so that an insulation spacing between the inner container and the outer layer can be adjusted.

In one embodiment of the above-mentioned double-layer container, the annular protrusion is formed by rolling up, and a cross-sectional width of the annular protrusion is greater than a depth of the annular groove, so that a gap is between the outer peripheral surface of the inner container and the inner peripheral surface of the outer layer. Through this structure, the outer layer at the locking structure also has the ability to prevent scalding, because an outer peripheral portion of the cup near the bottom is also a portion that is often held, and the enlarged width design is capable of reinforcing the deformation resistance of the rolled up annular protrusion, increasing the structural strength, and also increasing the heated clamping area. The rolled up structure of the annular protrusion can be formed of an arbitrary cross-sectional width, and, thus a size of the insulation gap between the inner cup and the outer cup is adjustable.

In one embodiment of the above-mentioned double-layer container, a groove cross-sectional shape of the annular groove is arcuate, square, or circular, and a protrusion cross-sectional shape of the annular protrusion is circular or oval. These shapes facilitate effective clamping during thermal expansion.

In one embodiment of the above-mentioned double-layer container, a mouth of the inner container has an annular flange bending outward from an outer wall of the inner container, the outer layer does not have a bottom, and the annular flange and the bottom of the inner container are exposed outside the outer layer, the tear tab is located at an edge of a lip of the outer layer and extends outside the lip of the outer layer, and the tear tab is bent toward an outer wall of the outer layer. The lip of the outer layer can be positioned with an upper portion of the inner container by tight fit, because an inner diameter of the lip of the outer layer is fixed, and the shape of the inner container is tapered, the closer to the mouth of the inner container, the greater the strength of tight fit. With this fixing method, the outer layer can be positioned at both upper and lower portions.

Under the premise of achieving rapid recycle, one embodiment of the tear tab can be fully utilized so that the tear tab is capable of tearing and destroying the outer layer, and at the same time is capable of reinforcing the glue-free fixed connection between the outer layer and the inner container, thereby increasing the strength of the double-layer container. That is, a lower portion of the outer layer is locked on the inner container by the locking structure. Under the premise of a position of the lower portion of the outer layer being limited, the tear tab being disposed at the lip of the outer layer, the tear tab being bent toward the outer wall of the outer layer, and a portion of the tear tab adjacent to the cup opening being abutted on the annular flange of the inner container; according to the different structures of the annular flange, such as the flat flange or the L-shaped flange, the tear tab can be bent and deformed outward to generate an elastic force to act on the outer layer, so that, through the locking structure of the snapped annular groove, the lower portion of the outer layer has a pre-tension force to avoid movements. Because the thin plastic inner container and the paper outer layer will have large thermal expansion and contraction, the locking structure will loosen, and the pre-tension force generated by the tear tab is capable of eliminating these effects, so that the entire outer layer can be firmly snapped on the inner container without glue, thereby increasing the strength during usage.

In one embodiment of the above-mentioned double-layer container, a part of the tear tab connected to the lip of the outer layer is an initiation portion, tear lines starting from the initiation portion are disposed on a body of the outer layer, and each of the tear lines is formed by serial dents reducing a thickness of the body of the outer layer. The tear lines can extend in any direction on the body of the outer layer, and the outer layer is more easily destroyed by the cooperation of the tear lines and the tear tab.

In one embodiment of the above-mentioned double-layer container, the annular flange is formed by rolling up the mouth of the inner container outward, and the tear tab bends outward and clings to the outer wall of the outer layer. This structure makes it easy to tear off the tear tab.

In one embodiment of the above-mentioned double-layer container, an end of the tear line at the initiation portion is a segment of dent, and the dent extends to the lip of the outer layer. Since the tear tab is pressed on the annular flange tightly, the outer layer can be easily torn off along the tear lines due to an inertial force generated during tearing and with coordination of the segment of dent. For optimal effect, the tear lines can be disposed along a direction of the inertial force, such as vertically downward.

In one embodiment of the above-mentioned double-layer container, the annular flange is formed by folding the mouth of the inner container outwardly into a flat shape, or the annular flange is formed by folding the mouth of the inner container outwardly twice to form an L-shaped cross section, the tear tab and the outer layer are an integrated structure, and a curled portion formed by bending the tear tab outwardly abuts on the annular flange. The integrated structure refers to the tear tab being cut into one integral part connected to the outer layer during the cutting process. The tear tab is capable of maintaining better elastic deformation when being bent outward, and abutment of the curled portion has the optimal elastic force.

In one embodiment of the above-mentioned double-layer container, an end of the tear line at the initiation portion is a segment of dent, and the segment of dent is kept at a distance away from the lip of the outer layer. Disposition of the tear line of such structure improves the strength of the cup opening, so that the tear tab can have the optimal elastic effect.

One embodiment of the present invention is achieved by the following technical solution:

A double-layer container, comprising: an inner container made of plastic and having a bottom, an outer layer made of paper and in a shape of a cylinder, sleeved outside the inner container, a locking structure provided between the outer layer and the inner container to snap the outer layer on an outer peripheral surface of the inner container; wherein the locking structure comprises an annular protrusion formed on the outer peripheral surface of the inner container, and an annular groove formed on the inner peripheral surface of the outer layer and recessed in a radial direction of the outer layer and in a rolled up manner, the annular protrusion is embedded in the annular groove; and wherein the outer layer is provided with a tear tab capable of tearing and destroying the outer layer.

One embodiment of the double-layer container can be further improved. The outer layer is directly made of plastic, the plastic is made into a plastic plate with a same thickness as A4 paper, and then the plastic plate is used as an outer paper cup. The same method mentioned above is employed to make a double-layer cup, so that it can be recycled during recycling without having to separate paper from plastic.

One embodiment of the present invention can further be implemented as: a double-layer container comprising an inner container made of plastic and having a bottom, and a cylindrical outer layer made of plastic, the outer layer is sleeved outside the inner container, wherein a locking structure is provided between the outer layer and the inner container, the locking structure is capable of snapping the outer layer on an outer peripheral surface of the inner container;

wherein the locking structure either comprises an annular groove formed on the outer peripheral surface of the inner container and recessed in a radial direction of the inner container, and an annular protrusion formed on an inner peripheral surface of the outer layer in a rolled up manner, or comprises the annular protrusion formed on the outer peripheral surface of the inner container, and the annular groove formed on the inner peripheral surface of the outer layer and recessed in a radial direction of the outer layer and in a rolled up manner and wherein the annular protrusion is embedded in the annular groove.

Compared with the prior art, one embodiment of the double-layer container has the following advantages:

1. The overall strength is high. The strength of the inner container and the outer layer is reinforced in the radial direction through the annular groove and the annular protrusion respectively, and the annular protrusion is embedded in the annular groove so that the annular protrusion supports the annular groove to further reinforce the overall strength.

2. When filled with hot drink, the outer layer can be further locked on the inner container through the locking structure. When the double-layer container is filled with cold drink or when the double-layer container is not in use, the connection is reinforced by the tear tab.

3. It can be conveniently and quickly recycled. Through the tear tab disposed on the outer layer, the outer layer can be easily destroyed and torn off, so that the outer layer can be easily separated from the inner container, thereby retrieving the plastic inner container without glue impurities.

4. The annular groove is formed on the inner container made of plastic material, and the paper outer layer is formed with the paper annular protrusion. When the double-layer container is used to hold high-temperature drinks, since the thermal expansion coefficients of plastic and paper are different, the thermal expansion of paper is almost not required to be considered, and the thin plastic annular groove will generate a small amount of thermal expansion. Based on the annular protrusion being embedded in the annular groove, the slight thermal expansion of upper and lower groove walls of the annular groove will further clamp and lock the annular protrusion to enhance the connection strength and reliability of use of the double-layer container. And the alternate locking structure, that is, the thin annular protrusion formed on the plastic inner container will also generate a small amount of thermal expansion. Based on the annular protrusion being embedded in the annular groove, the annular protrusion is expanded and tightly locked on the upper and lower groove walls of the annular groove with little thermal expansion.

DETAILED DESCRIPTION OF THE INVENTION

The technical solutions of the present invention are further described below with reference to the specific embodiments of the present invention in conjunction with the accompanied drawings, but the present invention is not limited to the embodiments.

Embodiment 1

Figure 1:
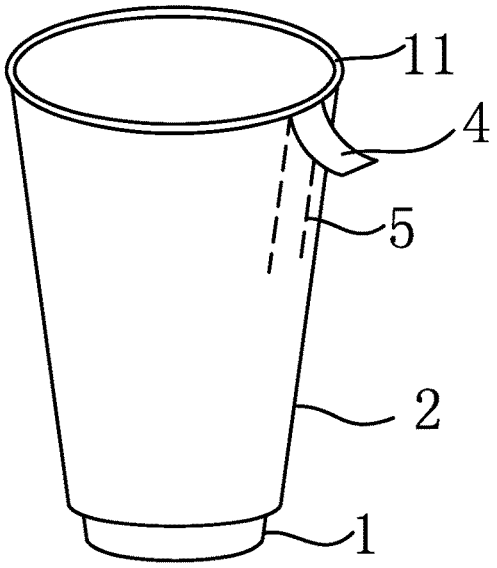
FIGS. 1-4 are schematic diagrams of different tear structures of one embodiment of a double-layer container.

As shown in FIG. 1, one embodiment of a double-layer container is a cup-shaped container, which has a circular platform shape, and includes an inner container 1 made of plastic and with a bottom, and an outer layer 2 made of paper. The outer layer 2 is sleeved outside the inner container 1, a mouth of the inner container 1 has an annular flange 11 bending outward from an outer wall of the inner container 1. The outer layer 2 does not have a bottom, and the annular flange 11 and the bottom of the inner container 1 are both located outside the outer layer 2. A locking structure is provided between the outer layer 2 and the inner container 1 to snap the outer layer 2 on an outer peripheral surface of the inner container 1. A tear tab 4 is provided on the outer layer 2 to tear and destroy the outer layer 2, and tear lines 5 are disposed on a body of the outer layer 2 and below the tear tab 4 to facilitate destroying the outer layer 2. The glue-free locking structure is capable of locking the outer layer 2 on the inner container 1, so that the outer layer 2 is firmly connected on the inner container 1, and, thus, not easy to separate from the inner container 1. For recycling after the double-layer container is used, through the tear tab 4 disposed on the outer layer 2, the outer layer 2 can be easily destroyed and torn off, so that the outer layer 2 can be easily separated from the inner container 1, thereby retrieving the plastic inner container 1 without glue impurities, and realizing rapid recycle.

Figure 2:
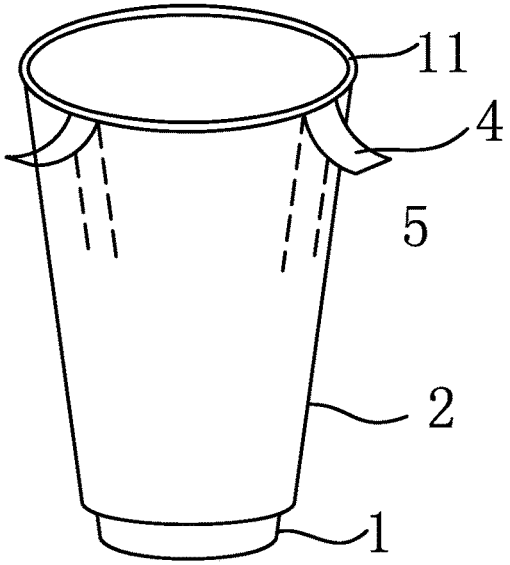
Figure 3:
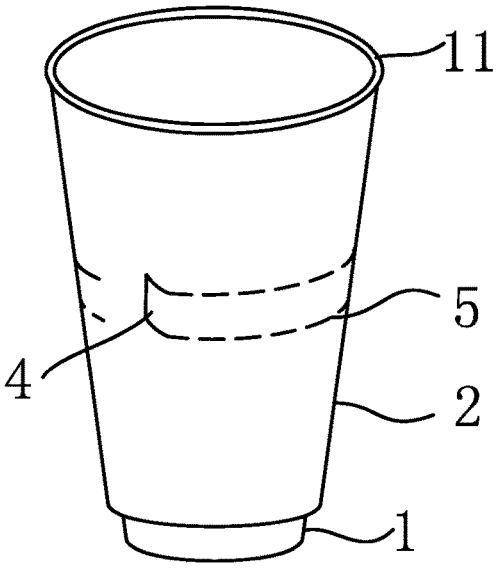
Figure 4:
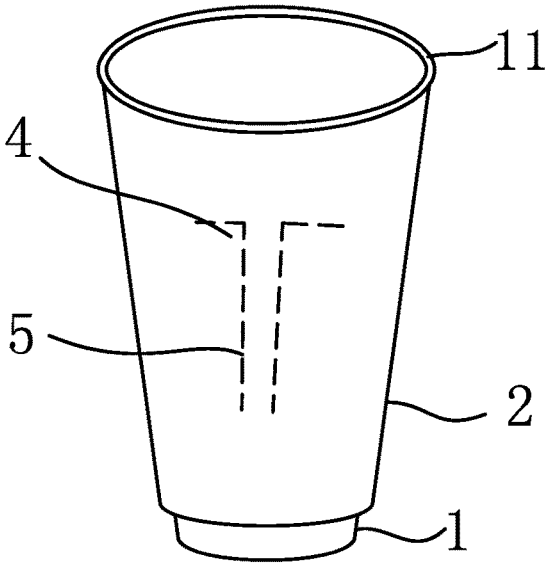

One embodiment of the tear tab 4 can have a variety of structures. As shown in FIG. 2, two sets of the tear tabs 4 and two sets of the tear lines 5 are disposed on the outer layer 2 of the double-layer container to facilitate destroying the outer layer 2. As shown in FIG. 3, the tear tab 4 is disposed on the body of the outer layer 2 and the tear lines 5 are disposed horizontally on an outer wall of the outer layer 2. As shown in FIG. 4, a portion of the body of the outer layer 2 is used as the tear tab 4, that is, a portion of the body of the outer layer 2 where the tear lines 5 form right-angle bends and the like, can be easily poked and pinched by fingers and used as the tear tab 4.

Figure 5:
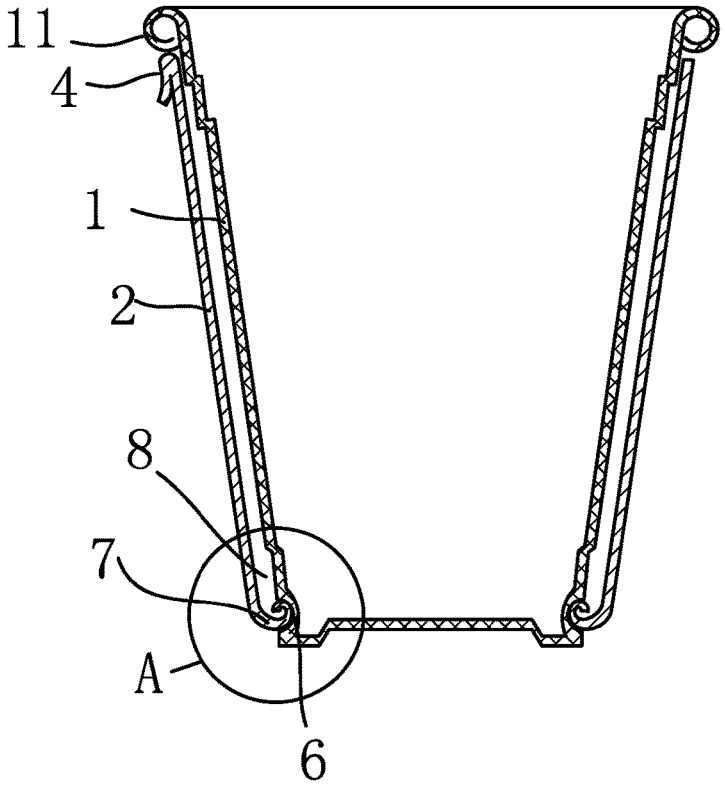
FIG. 5 is a cross-sectional view of one embodiment of the double-layer container.

As shown in FIG. 5, one embodiment of the locking structure is located at a lower portion or below a middle portion of the double-layer container, and includes an annular groove 6 and an annular protrusion 7. The annular groove 6 is recessed along a radial direction of the inner container 1 to form on the outer peripheral surface of the inner container 1, and has upper and lower groove walls 12, which are directly formed when the inner container 1 is press-molded, and a cross-sectional shape of the annular groove 6 is arcuate. The annular protrusion 7 is formed on an inner peripheral surface of the outer layer 2 by rolling up, that is, the annular protrusion 7 is formed by rolling up a lower portion of the outer layer 2 inward toward the inner peripheral surface. Depending on different technics, the annular protrusion 7 can be rolled up into a circular shape or an oval shape. The annular protrusion 7 is embedded in the annular groove 6, and a width of the annular protrusion 7 is larger than a depth of the annular groove 6 so that a gap 8 is between the outer wall of the inner container 1 and an inner wall of the outer layer 2. In order to ensure that the locking structure is sufficiently provided with the gap 8, a portion of the inner container 1 near the bottom is contracted inwardly, so that the gap 8 is increased. Adjustment is made through the annular protrusion 7 formed by rolling up. When the gap 8 needs to be enlarged, an outer diameter of the annular protrusion 7 can be increased accordingly. In actual production, adjustment of the gap 8 becomes easier for different environments of usage.

Figure 6:
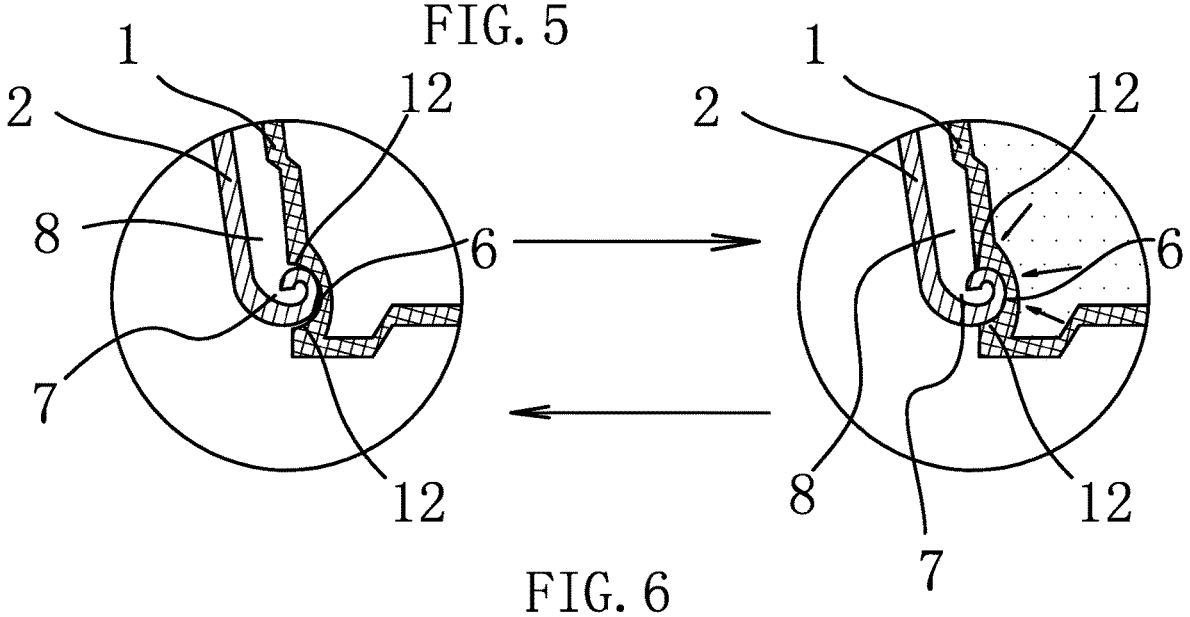
FIG. 6 is an enlarged view of portion A in FIG. 5 before and after thermal expansion.

As shown in FIG. 6, due to error of fitting size during the initial sleeving assembly of one embodiment of the locking structure, the annular protrusion 7 cannot be completely snapped in the annular groove 6. On the left side of FIG. 6, a groove width of the annular groove 6 is larger than a width of the annular protrusion 7 so that the fit of the annular protrusion 7 and the annular groove 6 is a clearance fit. This clearance fit will cause the outer layer 2 to move. But when the inner container 1 is filled with a high-temperature drink, since the thermal expansion coefficients of plastic and paper are different, the thermal expansion of paper is almost not required to be considered, and the thin plastic annular groove 6 will generate a small amount of thermal expansion. Furthermore, with a full cup of hot drink that deforms the plastic thin wall to form the optimal state shown on the right side of FIG. 6, the annular groove 6 is completely wrapped, attached and clamped tightly on the annular protrusion 7. After multiple sampling tests and observations, the upper and lower groove walls 12 are certainly capable of clamping and locking, which reduces the occurrence of movement. There are many reasons why it cannot be completely wrapped, which may due to combined effects of temperature and plastic materials, etc.

Figure 7:
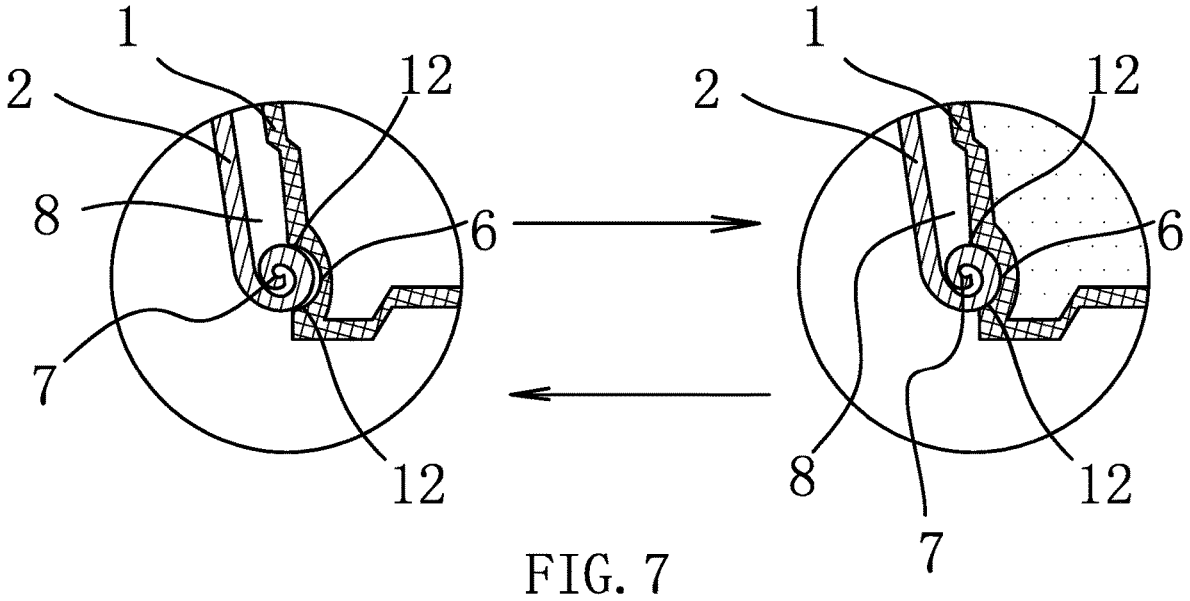
FIG. 7 is an enlarged structural view of the locking situation of one embodiment of an annular protrusion before and after thermal expansion.

As shown in FIG. 7, on the left side of FIG. 7, a width of one embodiment of the annular protrusion 7 is greater than a groove width of the annular groove 6. In this way, the annular protrusion 7 is only partially embedded in the annular groove 6. This structure is not very stable and it is easy for the inner container 1 to detach from the outer layer 2. When the inner container 1 is filled with a high-temperature drink, since the thermal expansion coefficients of plastic and paper are different, the thermal expansion of paper is almost not required to be considered, and the thin plastic annular groove 6 will generate a small amount of thermal expansion to deform the plastic thin wall to form the optimal state shown on the right side of FIG. 7. The annular protrusion 7 is completely embedded in the annular groove 6. After multiple sampling tests and observations, the upper and lower walls 12 are certainly capable of having more contact surfaces to contact with and clamp the annular protrusion 7 and to reduce the situation where the outer layer 2 is detached from the inner container 1.

In the case of not using one embodiment of the double-layer container and the double-layer container being used to hold a cold drink, the tear tab 4 can be fully utilized so that the tear tab 4 is capable of tearing and destroying the outer layer 2, and at the same time capable of reinforcing the glue-free fixed connection between the outer layer 2 and the inner container 1, thereby increasing the strength of the double-layer container. As shown in FIG. 5, the tear tab 4 is located at an edge of a lip of the outer layer 2 and extends outside the lip of the outer layer 2, the annular flange 11 is formed by rolling up the mouth of the inner container 1 outward, the tear tab 4 bends outward and clings to the outer wall of the outer layer 2, and a portion of the tear tab 4 adjacent to t the lip of the outer layer 2 is abutted on the annular flange 11 of the inner container 1. Such a structure makes a tight fit between the lip of the outer layer 2 and the annular flange 11, so that the outer layer 2 is fixed at an upper portion and at the lower portion.

As shown in FIG. 1, a part of one embodiment of the tear tab 4 connected to the lip of the outer layer 2 is an initiation portion, the tear lines 5 starting from the initiation portion are disposed on the body of the outer layer 2, and each of the tear lines 5 is formed by serial dents reducing a thickness of the body of the outer layer 2. The outer layer 2 is more easily destroyed by the cooperation of the tear lines 5 and the tear tab 4. As shown in an expanded view of the outer layer 2 shown in FIG. 8, an end of the tear line 5 at the initiation portion is a segment of dent, and the dent extends to the lip of the outer layer 2, and another end of the tear line 5 extends vertically downward. In this way, when the tear tab 4 is pulled out, the outer layer 2 can be easily torn off along the tear lines 5 by an inertial force cooperating with the segment of dent.

Embodiment 2

Figure 8:
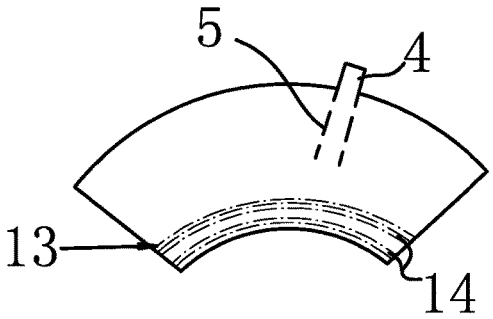
FIGS. 8 and 9 are positional relationship diagrams of one embodiment of tear lines and a tear tab.
Figure 12:
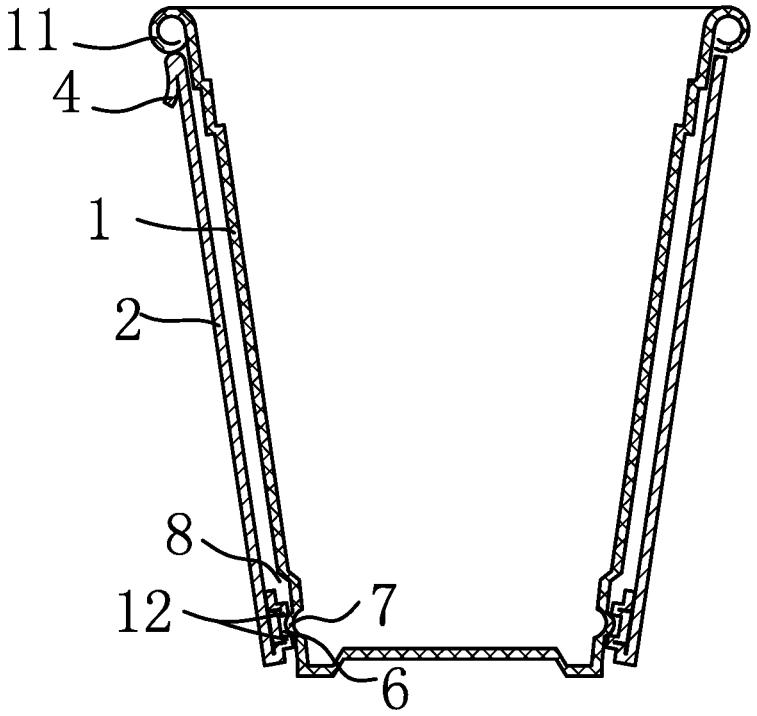
FIG. 12 is a cross-sectional view of the double-layered container according to a second embodiment.

The second embodiment is basically the same as the first embodiment, the difference lies in the locking structure. As shown in FIG. 12, the second embodiment includes the annular protrusion 7 formed on the outer peripheral surface of the inner container 1, and the annular groove 6, containing the upper and lower groove walls 12, formed on the inner peripheral surface of the outer layer 2. The annular protrusion 7 is embedded in the annular groove 6. The annular protrusion 7 on the inner container 1 is formed by protruding from inside to outside, and the annular groove 6 is formed by bending the lower portion of the outer layer 2. To combine FIG. 12 with what is shown in FIG. 8, the specific process is to first fold a fan-shaped cardboard of the outer layer 2 along a fold line 13 at the lower portion of the outer layer 2 and adhere to the inner wall of the outer layer 2, the folded portion is folded along a fold line 14 in a radial direction to form the two outwardly protruding upper and lower groove walls 12, and then bond the fan-shaped cardboard to form the tapered outer layer 2. Thereby, the inner container 1 is reinforced in the radial direction through the annular protrusion 7 on the plastic inner container 1, the annular groove 6 formed on the outer layer 2 is formed by the two protruding upper and lower groove walls 12, and the strength of the outer layer 2 is enhanced in a radial direction. Furthermore, the inner container 1 also generates a small amount of thermal expansion, and, based on the annular protrusion 7 being embedded in the annular groove 6, the annular protrusion 7 is expanded and tightly locked by the upper and lower groove walls 12 of the annular groove 6 with even less thermal expansion, so that the overall strength of the outer layer 2 and the inner container 1 in the radial direction is reinforced.

Embodiment 3

Figure 9:
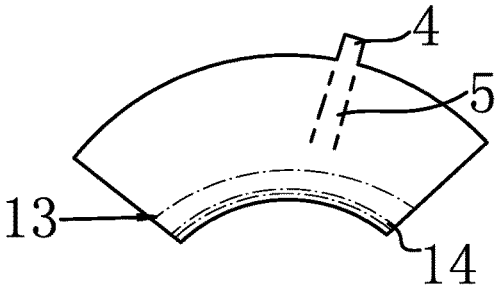
Figure 13:
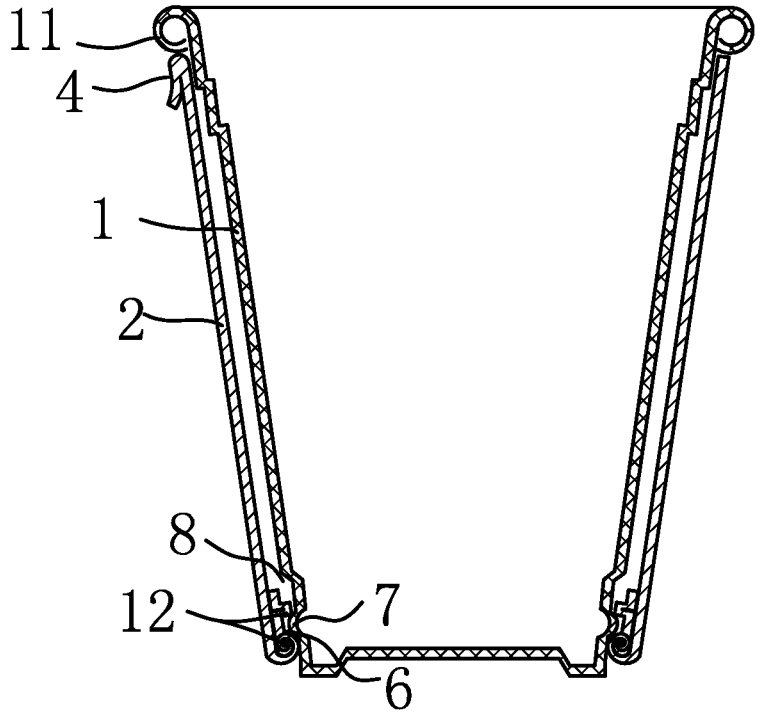
FIG. 13 is a cross-sectional view of the double-layered container according to a third embodiment.

The third embodiment is basically the same as the second embodiment, the difference lies in the upper and lower groove walls 12 of the annular groove 6. As shown in FIG. 13 and FIG. 9, the specific process is to first fold a fan-shaped cardboard of the outer layer 2 along the fold line 13 at the lower portion of the outer layer 2 and adhere to the inner wall of the outer layer 2, the folded portion is folded along the fold line 14 in a radial direction to form the outwardly protruding upper groove wall 12, and then bond the fan-shaped cardboard to form the tapered outer layer 2. The double-layer cardboard at the fold line 13 is rolled up to form the lower groove wall 12, that is, the lower groove wall 12 is formed by rolling up the double-layer cardboard. Such a structure is capable of further reinforcing the structural strength of the outer layer 2 in the radial direction.

Embodiment 4

Figure 10:
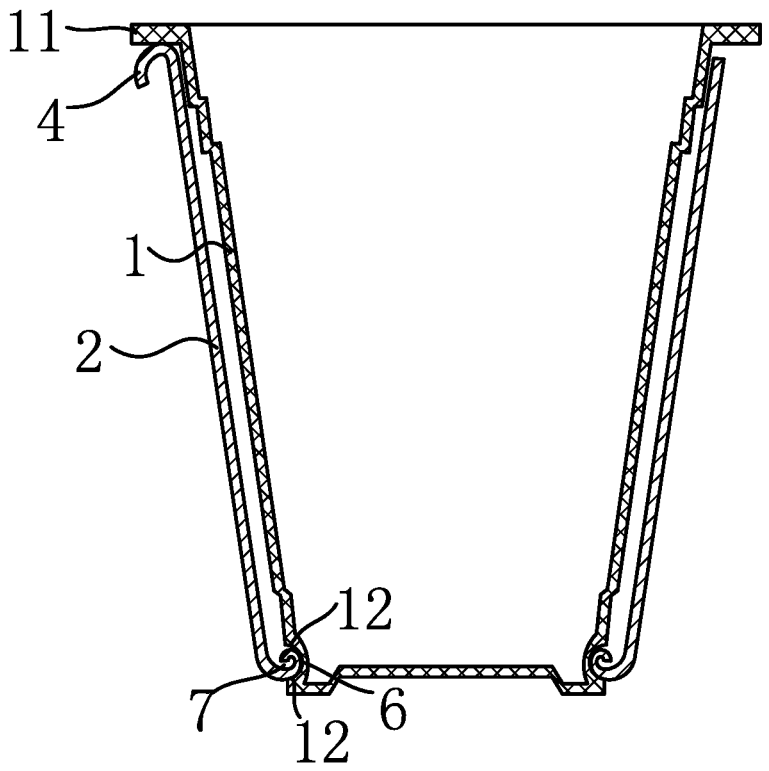
FIGS. 10 and 11 are cross-sectional views of different annular flanges in a fourth embodiment.
Figure 11:
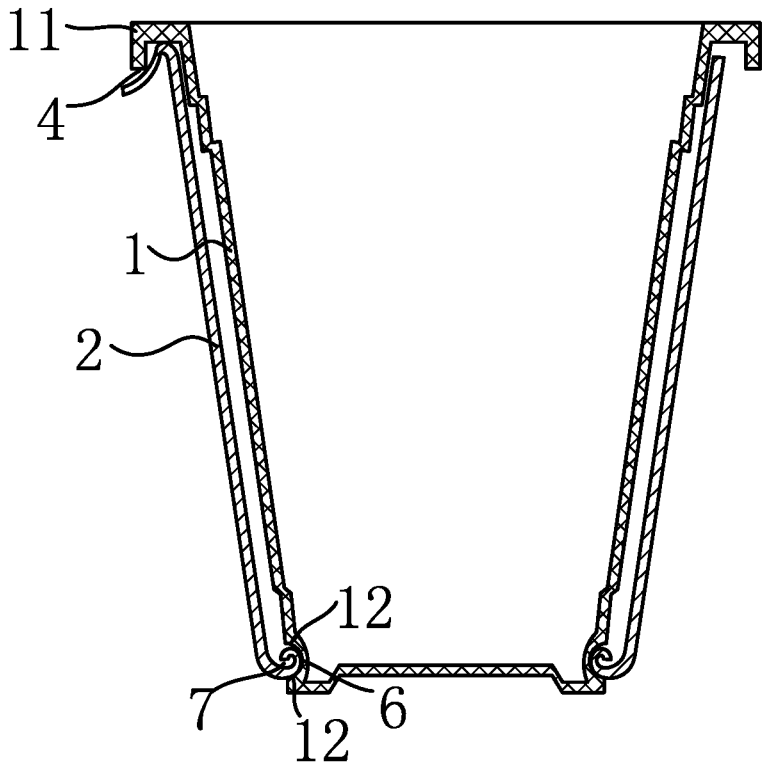

The fourth embodiment is basically the same as the first embodiment. The difference is that the tear tab 4 is bent outwardly to deform and generate an elastic force to act on the outer layer 2, so that the lower portion of the outer layer 2 has a pre-tension force through the locking structure of the annular groove 6 to avoid movements. As shown in FIG. 9, the expanded state of the outer layer 2 is cut according to FIG. 9, and then when the outer layer 2 is formed by rolling up and bonding, the tear tab 4 and the outer layer 2 are an integrated structure, such the tear tab 4 is capable of maintaining better elastic deformation when bending outward. As shown in FIG. 10, the annular flange 11 is formed by folding the inner container 1 outwardly into a flat shape, or as shown in FIG. 11, the annular flange 11 is formed by folding the mouth of the inner container 1 outwardly twice to form an L-shaped cross section, and a curled portion formed by bending the tear tab 4 outwardly abuts on the annular flange 11. An end of the tear line 5 of this structure at the initiation portion is the segment of dent, and the segment of dent is kept at a distance away from the lip of the outer layer 2 to increase the strength of the cup opening, so that the tear tab 4 can have the optimal elastic effect.

Embodiment 5

Figure 14:
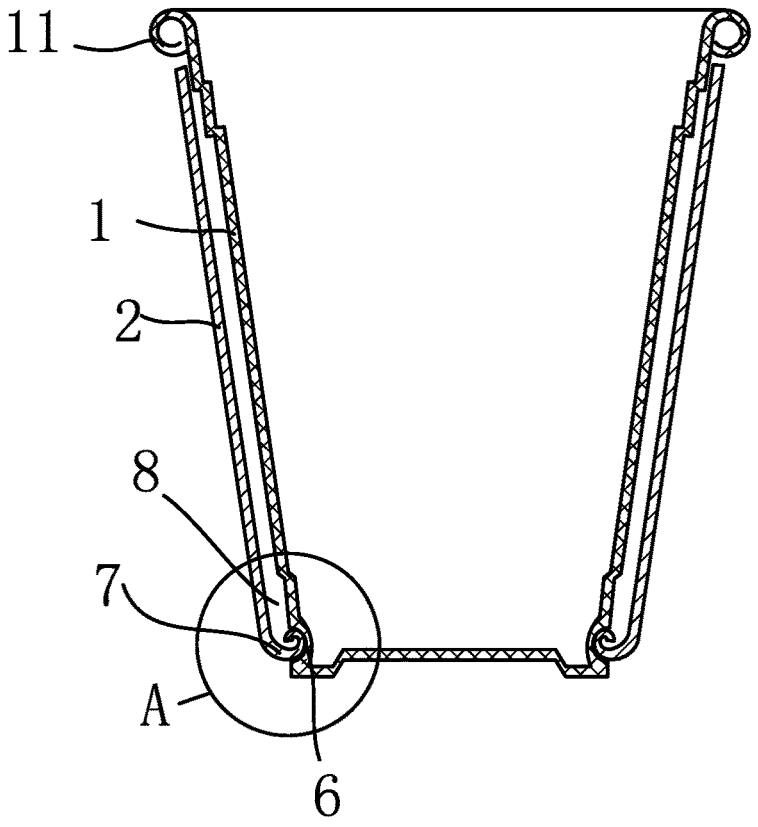
FIGS. 14 and 15 are cross-sectional views of the double-layer container according to a fifth embodiment.
Figure 15:
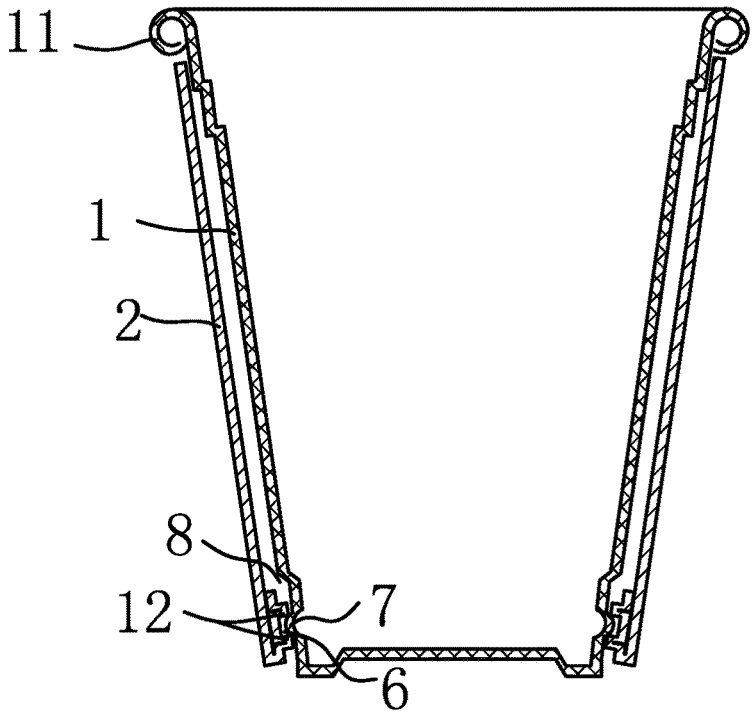

As shown in FIG. 14, the double-layer container comprises the inner container 1 made of plastic and having the bottom, and the outer layer 2 made of plastic, the outer layer 2 is sleeved outside the inner container 1, and the locking structure is provided between the outer layer 2 and the inner container 1, the locking structure is capable of snapping the outer layer 2 on the outer peripheral surface of the inner container 1. The plastic used for the outer layer 2 is a thin plastic plate with a thickness of 0.5 mm-2 mm. This thin plastic plate is rolled up and folded to form the outer layer 2. The locking structure is the same as the locking structure of the first embodiment. The locking structure is located at the lower portion or below the middle portion of the double-layer container, and includes the annular groove 6 and the annular protrusion 7. The annular groove 6 is recessed along the radial direction of the inner container 1 to form on the outer peripheral surface of the inner container 1, and has the upper and lower groove walls 12, which are directly formed when the inner container 1 is press-molded, and the cross-sectional shape of the annular groove 6 is arcuate. The annular protrusion 7 is formed on the inner peripheral surface of the outer layer 2, that is, the annular protrusion 7 is formed by rolling up the lower portion of the outer layer 2 inward toward the inner peripheral surface. Depending on different technics, the annular protrusion 7 can be rolled up into a circular shape or an oval shape. The annular protrusion 7 is embedded in the annular groove 6, and a width of the annular protrusion 7 is larger than a depth of the annular groove 6 so that the gap 8 is between the outer wall of the inner container 1 and the inner wall of the outer layer 2. Alternatively, the locking structure is the same as that in the second embodiment. As shown in FIG. 15, the locking structure includes the annular protrusion 7 formed on the outer peripheral surface of the inner container 1, and the annular groove 6 with the upper and lower walls 12 and formed on the inner peripheral surface of the outer layer 2. The annular protrusion 7 is embedded in the annular groove 6. The annular protrusion 7 on the inner container 1 is formed by protruding from inside to outside, and the annular groove 6 is formed by bending the lower portion of the outer layer 2.

The specific embodiments described herein are merely illustrative of the spirit of the present invention. Technical personnel skilled in the art to which the present invention pertains can make various modifications or additions to the specific embodiments described or replace them in a similar manner, without departing from the spirit of the present invention or beyond the scope defined by the appended claims.

LIST OF REFERENCED PARTS

1 inner container
11 annular flange

12 upper and lower groove walls
2 outer layer
4 tear tab
5 tear line
6 annular groove
7 annular protrusion
8 gap

What is claimed is:

1. A double-layer container, comprising:

an inner container made of plastic and having a bottom;

an outer layer made of paper and in a shape of a cylinder, sleeved outside the inner container; and a locking structure provided between the outer layer and the inner container to snap the outer layer on an outer peripheral surface of the inner container, the locking structure located at a lower portion or below a middle portion of the inner container;

wherein the locking structure either comprises an annular groove formed on the outer peripheral surface of the inner container and recessed in a radial direction of the inner container, and an annular protrusion formed on an inner peripheral surface of the outer layer in a rolled up manner, or comprises an annular protrusion formed on the outer peripheral surface of the inner container, and an annular groove formed on the inner peripheral surface of the outer layer and recessed in a radial direction of the outer layer and in a rolled up manner, the annular protrusion is embedded in the annular groove;

wherein the outer layer is provided with a tear tab capable of tearing and destroying the outer layer, the tear tab and the outer layer are an integrated structure; and wherein a mouth of the inner container has an annular flange bending outward from an outer wall of the inner container, and a portion of the tear tab adjacent to the cup opening is abutted on the annular flange of the inner container.

2. The double-layer container as claimed in claim 1, wherein the annular protrusion is formed by rolling up, and a cross-sectional width of the annular protrusion is greater than a depth of the annular groove, so that a gap is between the outer peripheral surface of the inner container and the inner peripheral surface of the outer layer.

3. The double-layer container as claimed in claim 1, wherein a groove cross-sectional shape of the annular groove is arcuate, square, or circular, and a protrusion cross-sectional shape of the annular protrusion is circular or oval.

4. The double-layer container as claimed in claim 1, wherein the outer layer does not have a bottom, and the annular flange and the bottom of the inner container are exposed outside the outer layer, the tear tab is located at an edge of a lip of the outer layer and extends outside the lip of the outer layer, and the tear tab is bent toward an outer wall of the outer layer.

5. The double-layer container as claimed in claim 4, wherein a part of the tear tab connected to the lip of the outer layer is an initiation portion, tear lines starting from the initiation portion are disposed on a body of the outer layer, and each of the tear lines is formed by serial dents reducing a thickness of the body of the outer layer.

6. The double-layer container as claimed in claim 5, wherein an end of each of the tear lines at the initiation portion is a segment of dent, and the dent extends to the lip of the outer layer.

7. The double-layer container as claimed in claim 5, wherein an end of each of the tear lines at the initiation portion is a segment of dent, and the segment of dent is kept at a distance away from the lip of the outer layer.

8. The double-layer container as claimed in claim 4, wherein the annular flange is formed by rolling up the mouth of the inner container outward, and the tear tab bends outward and clings to the outer wall of the outer layer.

9. The double-layer container as claimed in claim 4, wherein the annular flange is formed by folding the mouth of the inner container outwardly into a flat shape, or the annular flange is formed by folding the mouth of the inner container outwardly twice to form an L-shaped cross section, and a curled portion formed by bending the tear tab outwardly abuts on the annular flange.

10. A double-layer container, comprising:

an inner container made of plastic and having a bottom;

an outer layer made of paper and in a shape of a cylinder, sleeved outside the inner container; and a locking structure provided between the outer layer and the inner container to snap the outer layer on an outer peripheral surface of the inner container, the locking structure located at a lower portion or below a middle portion of the inner container;

wherein the locking structure either comprises an annular protrusion formed on the outer peripheral surface of the inner container, and an annular groove formed on an inner peripheral surface of the outer layer and recessed in a radial direction of the outer layer and in a rolled up manner, or comprises an annular protrusion formed on the outer peripheral surface of the inner container, and an annular groove formed on the inner peripheral surface of the outer layer and recessed in a radial direction of the outer layer and in a rolled up manner, the annular protrusion is embedded in the annular groove;

wherein the outer layer is provided with a tear tab capable of tearing and destroying the outer layer, the tear tab and the outer layer are an integrated structure; and wherein a mouth of the inner container has an annular flange bending outward from an outer wall of the inner container, and a portion of the tear tab adjacent to the cup opening is abutted on the annular flange of the inner container.

11. The double-layer container as claimed in claim 10, wherein a cross-sectional width of the annular protrusion is greater than a depth of the annular groove, so that a gap is between the outer peripheral surface of the inner container and the inner peripheral surface of the outer layer.

12. The double-layer container as claimed in claim 10, wherein a groove cross-sectional shape of the annular groove is arcuate, square, or circular, and a protrusion cross-sectional shape of the annular protrusion is circular or oval.

13. The double-layer container as claimed in claim 10, wherein the outer layer does not have a bottom, and the annular flange and the bottom of the inner container are exposed outside the outer layer, the tear tab is located at an edge of a lip of the outer layer and extends outside the lip of the outer layer, and the tear tab is bent toward an outer wall of the outer layer.

14. The double-layer container as claimed in claim 13, wherein a part of the tear tab connected to the lip of the outer layer is an initiation portion, tear lines starting from the initiation portion are disposed on a body of the outer layer, and each of the tear lines is formed by serial dents reducing a thickness of the body of the outer layer.

15. The double-layer container as claimed in claim 14, wherein an end of each of the tear lines at the initiation portion is a segment of dent, and the dent extends to the lip of the outer layer.

16. The double-layer container as claimed in claim 14, wherein an end of each of the tear lines at the initiation portion is a segment of dent, and the segment of dent is kept at a distance away from the lip of the outer layer.

17. The double-layer container as claimed in claim 13, wherein the annular flange is formed by rolling up the mouth of the inner container outward, and the tear tab bends outward and clings to the outer wall of the outer layer.

18. The double-layer container as claimed in claim 13, wherein the annular flange is formed by folding the mouth of the inner container outwardly into a flat shape, or the annular flange is formed by folding the mouth of the inner container outwardly twice to form an L-shaped cross section, and a curled portion formed by bending the tear tab outwardly abuts on the annular flange.

* * * * *